US007891057B2

(12) United States Patent
Brugger

(10) Patent No.: US 7,891,057 B2
(45) Date of Patent: Feb. 22, 2011

(54) HINGE BEARING BLOCK

(75) Inventor: Anton Brugger, Osterreich (AT)

(73) Assignee: Liebherr-Hausgeräate Lienz GmbH, Lienz (AT)

( * ) Notice: Subject to any disclaimer, the term of this patent is extended or adjusted under 35 U.S.C. 154(b) by 368 days.

(21) Appl. No.: 11/990,802

(22) PCT Filed: Aug. 24, 2006

(86) PCT No.: PCT/EP2006/008323

§ 371 (c)(1),
(2), (4) Date: Feb. 21, 2008

(87) PCT Pub. No.: WO2007/022984

PCT Pub. Date: Mar. 1, 2007

(65) Prior Publication Data

US 2009/0133225 A1 May 28, 2009

(30) Foreign Application Priority Data

Aug. 25, 2005 (DE) ..... 20 2005 013 460 U

(51) Int. Cl.
*E05D 5/00* (2006.01)

(52) U.S. Cl. ..... 16/382; 16/386; 16/268; 16/244

(58) Field of Classification Search ..... 016/382, 016/386, 268, 240, 244, 245, 246, 271; 049/381, 049/388, 397; 312/326, 405, 138.1, 329, 312/325, 109, 136
See application file for complete search history.

(56) References Cited

U.S. PATENT DOCUMENTS

| | | | | |
|---|---|---|---|---|
| 2,302,484 | A | 11/1942 | Werner | |
| 3,592,257 | A * | 7/1971 | Matyas | 160/186 |
| 3,683,453 | A | 8/1972 | McLeland et al. | |
| 4,151,681 | A | 5/1979 | Roberts | |
| 4,238,908 | A * | 12/1980 | Bunce | 49/501 |
| 4,774,740 | A * | 10/1988 | Gidseg et al. | 16/344 |
| 4,815,162 | A | 3/1989 | McAteer | |
| 4,932,729 | A * | 6/1990 | Thompson et al. | 312/405 |
| 5,548,869 | A * | 8/1996 | Ryczek | 16/93 R |
| 5,568,673 | A * | 10/1996 | Ryczek | 16/244 |
| 5,788,351 | A * | 8/1998 | Prunty et al. | 312/326 |
| 2006/0143860 | A1 * | 7/2006 | Park et al. | 16/243 |
| 2009/0038117 | A1 * | 2/2009 | Moon | 16/240 |

FOREIGN PATENT DOCUMENTS

| | | |
|---|---|---|
| EP | 1505234 | 2/2005 |
| FR | 2455157 | 11/1980 |
| FR | 2501274 | 9/1982 |
| JP | 09-33161 | 2/1997 |

* cited by examiner

*Primary Examiner*—Chuck Y. Mah
(74) *Attorney, Agent, or Firm*—Dilworth & Barrese, LLP

(57) ABSTRACT

A bearing block has a screw guided through a bore of the bearing block as well as a bearing sleeve which has an internal thread which is in engagement with the external thread of the screw and whose outer surface serves as a door support.

11 Claims, 1 Drawing Sheet

HINGE BEARING BLOCK

BACKGROUND OF THE INVENTION

The invention relates to a bearing block having a screw guided through a bore of the bearing block.

Such a bearing block is known from the prior art. In already known embodiments, the screw guided through the bearing block is made as a bearing screw which has a threaded section as well as a section without a thread which serves as a bearing for a door of an appliance. The adjustment of the bearing block is realized by means of a fixing plate which is received in a guide at the rear side of the bearing block. This fixing plate is inserted into the bearing block before the assembly of the door and is fixed by screwing in the bearing screw.

An embodiment of this type known from the prior art is shown in FIG. 1, left hand representation. The bearing block is marked by 10 in it and the fixing plate is marked by the reference numeral 20. As can be recognized from FIG. 1, left hand representation, the fixing plate 20 is received in a groove on the rear side of the bearing block 10. The bearing block 10 has a bore through which the bearing screw 30 is guided. The bearing screw 30 has a threaded section which is in engagement with the internal thread of the fixing plate 20 and fixes the bearing block 10 to the fixing plate 20 in this manner.

The thickness or height of the bearing block 10 cannot be appreciably reduced due to the thickness of the fixing plate 20 and the said guidance in the bearing block 10.

SUMMARY OF THE INVENTION

It is therefore the underlying object of the invention to further develop a bearing block of the first named kind such that it has a reduced thickness with respect to previously known embodiments.

This object is solved by a bearing block having the features herein. Provision is accordingly made for the bearing block to have a bearing sleeve which has an internal thread which is in engagement with the external thread of the screw and whose outer surface serves as a door support. The bearing block in accordance with the invention thus manages without the fixing plate known from the prior art. It is thus also not necessary to provide a groove for the reception of a fixing plate in the rearward region of the bearing block. The fixing of the bearing sleeve takes place in that the named bearing sleeve is screwed onto the screw guided through the bearing block and said screw is then tightened. A lower thickness of the bearing block can thus be achieved by the embodiment of the bearing block in accordance with the invention than with the already known solution in accordance with FIG. 1, left hand representation.

The bearing block can be connected to an installation plate which has one or more bores for the fixing of the plate at the carcass of the appliance or of any other component. It is conceivable that the appliance is a refrigerator unit and/or a freezer unit at whose front side or—in the case of a chest—at whose upper side the installation plate is arranged. In this connection, the bearing block preferably extends perpendicular to the installation plate and parallel to the upper edge of a door arranged at the appliance.

Provision can furthermore be made for the bore of the bearing block through which the screw is guided to be made as an elongate bore. This makes it possible to carry out a particularly simple adjustment of the door. A door supported by means of the bearing block in accordance with the invention can be aligned particularly simply in this manner. It is only necessary for this purpose to release the bearing sleeve from the screw guided through the bore of the bearing block, to displace it into the desired position in the elongate bore and then to tighten it again by means of the screw.

The bearing block can be made as a cast part, for example.

It is particularly advantageous for the internal thread of the bearing sleeve to extend over the whole length or over a substantial length of the hollow space of the bearing sleeve. With the bearing block known from the prior art, there is the risk that the thread at the fixing plate, which holds the bearing block in its position, tears off at too high a torque. Since in accordance with this embodiment of the invention, in the bearing block of the invention, the thread extends substantially over the total length of the sleeve, this risk is no longer given.

Provision can furthermore be made for the bearing sleeve to have a first section in which the hollow space having the internal thread is located and a second section which is formed by a guide plate which adjoins the first section. Provision can be made in this connection for the bearing bock to have a cut-out on its side remote from the guide plate in which the guide plate can be received or is received in the assembled state.

It is particularly advantageous for the cut-out to have a depth which corresponds to or exceeds the thickness of the guide plate. This has the result that the thickness of the guide plate does not contribute to the total thickness of the bearing block. It is rather the case that, in accordance with this embodiment of the invention, the guide plate does not project beyond the bearing block in the assembled state so that the total thickness of the arrangement is determined by the thickness of the bearing block.

Provision can furthermore be made for the cut-out to be made as a groove. The groove preferably extends parallel to the plane which is formed by the installation plate. The groove preferably extends parallel to the front side or to the upper side of a refrigerator unit and/or freezer unit so that the door or a cover of the appliance can be aligned accordingly.

Provision is made in a further embodiment of the invention that the guide plate is rectangular or square shaped.

The invention further relates to a refrigerator unit and/or a freezer unit having a door and/or a cover, with the appliance having at least one bearing block in accordance with the description herein and with the bearing sleeve being received in a recess of the door or of the cover. The appliance can, for example, be a refrigerator or a freezer, a fridge/freezer combination or also a refrigerator or freezer chest. In the case of a refrigerator or freezer or a combination made as a cabinet, the bearing block in accordance with the invention preferably forms the upper support of the door. The lower bearing of the door can be fixed, i.e. made to be non-adjustable. The possibility generally exists of also making the lower bearing in accordance with the present invention.

BRIEF DESCRIPTION OF THE DRAWINGS

Further details and advantages of the invention will be explained in more detail with reference to an embodiment shown in the drawing.

There are shown.

DESCRIPTION OF THE PREFERRED EMBODIMENTS

Figure 1:
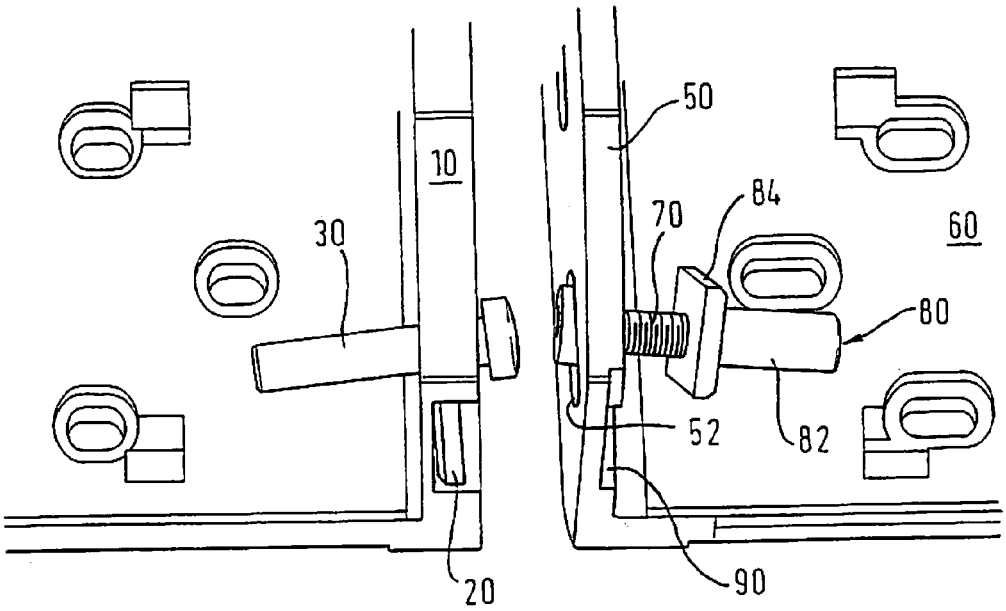
FIG. 1: left hand representation: an image of the bearing block in accordance with the prior art; right hand representation: an image of the bearing block in accordance with the invention.
Figure 2:
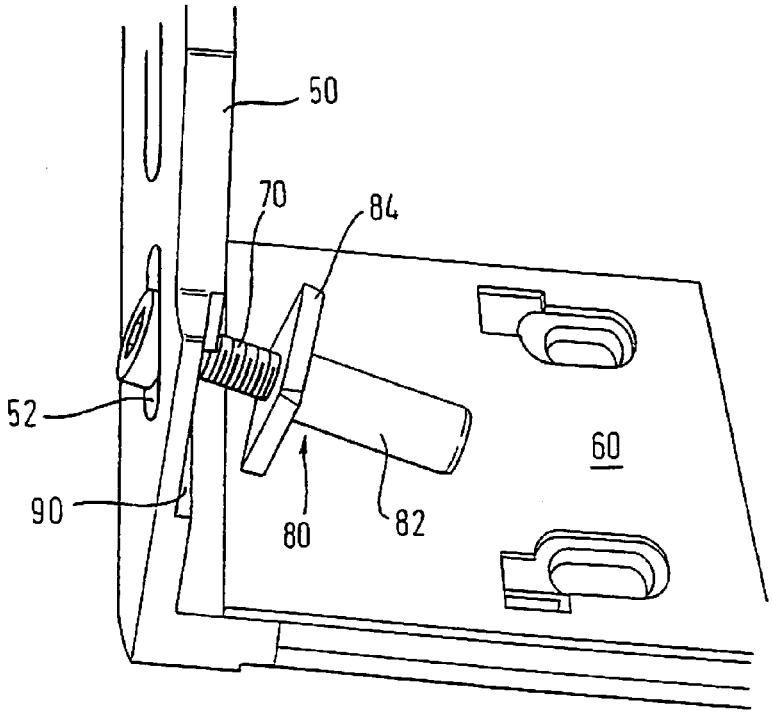
FIG. 2: a further image of the bearing block in accordance with FIG. 1, right hand representation.

The inventive bearing block in accordance with the present invention is provided with the reference numeral 50 in FIG. 1, right hand image, and in FIG. 2. The bearing block 50 is connected in one piece to the installation plate 60 which extends at right angles to the bearing block 50. The installation plate 60 serves for the installation of the arrangement at the carcass of a refrigerator unit and/or freezer unit. For this purpose, the installation plate 60 has bores for the reception of corresponding fastening screws.

The bearing block 50 has an elongate bore 52 which extends parallel to the plane formed by the installation plate 60.

The screw 70 is received in this elongate bore 52 and its head is dimensioned such that the head of the screw 70 lies on the marginal region of the elongate bore 52.

The bearing block 50 in accordance with the invention furthermore comprises the bearing sleeve 80.

The bearing sleeve 80 has a cylindrical section 82 and the guide plate 84 which adjoins it directly and which can be square or preferably rectangular in plan view. The guide plate 84 and the cylindrical bearing section 82 are made in the form a component, i.e. in one piece, and form the bearing sleeve 80.

The cylindrical section 82 of the bearing sleeve 80 has a hollow space which extends in the axial direction of the section 82, is provided with an internal thread and in which a section of the screw 70 is received in the installed state of the bearing block 50. The internal thread of the bearing sleeve 80 is in engagement with the external thread of the screw 70.

The outer side of the cylindrical section 82 of the bearing sleeve 80 is made smooth and serves as an upper door bearing, i.e. the bearing sleeve 80 is received in a bore located at the upper side of the door in the installed state of the door of the appliance such that the door is pivotable around the bearing sleeve 80.

On the side of the bearing block 50 facing the bearing sleeve 80, said bearing block has a groove 90 which is open to the side of the bearing block 50 and extends parallel to the plane formed through the installation plate 60 or to the plane formed through the closed door of the apparatus and parallel to the elongate bore 52.

The groove 90 is dimensioned such that the guide plate 84 can be received in it.

On the installation of the door, it is first placed onto the lower door bearing. The bearing sleeve 80 or its lower section 82 is then inserted into the upper bearing bore of the door. Subsequently, the screw 70 guided through the elongate bore 52 of the bearing block 50 is introduced into the bearing sleeve 80 and is screwed to it until the guide plate 84 is received in the groove 90 of the bearing block 50. The depth of the groove 90 is selected such that it does not exceed the thickness of the guide plate 84, i.e. the guide plate 84 is received in the groove such that it does not project beyond it. The total thickness of the arrangement in the assembled state is thus determined by the thickness of the bearing block 50.

In the assembled state, the bearing block 50 is bounded by the head of the screw 70 on the upper side and by the guide plate 84 on the lower side. The screw 70 and the bearing sleeve 80 are fixed in their positions relative to the bearing block 50 in this manner.

If the inclination of the door should be adjusted, the screw 70, which is accessible from above by means of a suitable tool, is released such that the screw 70 and the guide plate 84 can be displaced in the groove 90 of the bearing block 50 until the desired inclination of the door is obtained. As soon as this is the case, the screw 70 is tightened again and the bearing sleeve 80, and thus also the door, are again fixed in their positions.

The bearing block in accordance with the invention has the advantage that the thickness of the bearing block and thus also the thickness or height of the appliance top can thus be considerably reduced with respect to the previously known solution, substantially to the height of the guide plate. There is furthermore an advantage that due to the fact that the internal thread of the bearing sleeve can be made over the latter's total length, the risk of the tearing off of the thread existing with the previously known arrangement is eliminated.

The invention claimed is:

1. A bearing block having a screw guided through a bore of the bearing block as well as having a bearing sleeve which has a hollow space having an internal thread which is in engagement with the external thread of the screw and whose outer surface serves as a door support, wherein the bearing sleeve has a first section in which the hollow space having the internal thread is located and a second section which is formed by a guide plate which adjoins the first section, and the bearing block has a recess, in which the guide plate can be received, on its side facing the guide plate.

2. A bearing block in accordance with claim 1, wherein the bearing block is connected to an installation plate which has one or more bores for the fixing of the installation plate to the carcass of an appliance, said appliance being a refrigerator unit and/or freezer unit.

3. A bearing block in accordance with claim 2, wherein the recess is made as a groove, and the groove extends parallel to the plane formed by the installation plate.

4. A bearing block in accordance with claim 1, wherein the bore of the bearing block through which the screw is guided is made as an elongate bore.

5. A bearing block in accordance with claim 1, wherein the bearing block is made as a cast part.

6. A bearing block in accordance with claim 1, wherein the internal thread of the bearing sleeve extends over the total length of the first section of the bearing sleeve.

7. A bearing block in accordance with claim 1, wherein the recess has a depth which corresponds to or exceeds the thickness of the guide plate.

8. A bearing block in accordance with claim 1, wherein the recess is made as a groove.

9. A bearing block in accordance with claim 1, wherein the guide plate is made rectangular or square.

10. A bearing block in accordance with claim 1, wherein the bearing sleeve is received at least sectionally in a recess of a door or cover of a refrigerator and/or freezer unit.

11. A bearing block in accordance with claim 10, wherein the bearing block forms an upper support of the door of the refrigerator and/or freezer unit.

* * * * *